US005264757A

United States Patent [19]

Snijkers et al.

[11] Patent Number: 5,264,757

[45] Date of Patent: Nov. 23, 1993

[54] SCANDATE CATHODE AND METHODS OF MAKING IT

[75] Inventors: Frans M. M. Snijkers; Jacobus E. Crombeen, both of Eindhoven, Netherlands

[73] Assignee: U.S. Philips Corporation, New York, N.Y.

[21] Appl. No.: 606,020

[22] Filed: Oct. 30, 1990

[30] Foreign Application Priority Data

Nov. 13, 1989 [NL] Netherlands ..... 8902793

[51] Int. Cl.[5] ..... H01J 1/28

[52] U.S. Cl. ..... 313/346 R; 313/346 DC; 313/270; 313/337; 313/340; 313/345; 313/355

[58] Field of Search ..... 313/346 R, 346, DC, 313/270, 337, 340, 345, 355; 252/515, 521

[56] References Cited

U.S. PATENT DOCUMENTS

| | | | |
|---|---|---|---|
| 3,358,178 | 12/1967 | Figner et al. | 313/346 R |
| 4,007,393 | 2/1977 | Van Stratum et al. | 313/346 R |
| 4,350,920 | 9/1982 | Bertens | 252/521 X |
| 4,518,890 | 5/1985 | Taguchi et al. | 313/346 R |
| 4,594,220 | 1/1986 | Hasker et al. | 313/337 X |
| 4,625,142 | 11/1986 | van Esdonk et al. | 313/346 DC |
| 4,626,470 | 12/1986 | Yamamoto et al. | 428/336 |
| 4,783,613 | 11/1988 | Yamamoto et al. | 313/346 R |
| 4,797,593 | 1/1989 | Saito et al. | 313/346 R |
| 4,855,637 | 2/1988 | Watanabe et al. | 313/346 R |
| 5,006,753 | 4/1991 | Hasker et al. | 313/346 R |
| 5,064,397 | 11/1991 | Hasker et al. | 445/50 |

FOREIGN PATENT DOCUMENTS

| | | | |
|---|---|---|---|
| 178716 | 4/1986 | European Pat. Off. . | |
| 0298558 | 1/1989 | European Pat. Off. | 313/340 |
| 0317002 | 5/1989 | European Pat. Off. | 313/340 |

OTHER PUBLICATIONS

"Properties and Manufacture of Top-Layer Scandate Cathodes", Applied Surface Science, 26, (1986), pp. 173-195, (Apr. 1986).

*Primary Examiner*—Sandra L. O'Shea
*Assistant Examiner*—Ashok Patel
*Attorney, Agent, or Firm*—Ernestine C. Bartlett

[57] ABSTRACT

To maintain a monolayer of scandium, which is necessary for a satisfactory emission on the surface of a scandate cathode, at least the top layer of the cathode is provided with a scandium-containing oxidic phase from which Scandium is supplied by segregation from this oxidic phase.

10 Claims, 1 Drawing Sheet

SCANDATE CATHODE AND METHODS OF MAKING IT

BACKGROUND OF THE INVENTION

The invention relates to a scandate cathode having a cathode body which comprises a matrix of a high-melting point metal and/or alloy such as refractory metals and/or alloys thereof a barium compound in contact with the matrix material, to supply barium to the emissive surface by a chemical reaction with the matrix material and a top layer of a Scandium containing material.

The invention also relates to methods of manufacturing such a cathode.

Cathodes of the type mentioned in the opening paragraph are described in the article "Properties and manufacture of top-layer scandate cathodes", Applied Surface Science, 26 (1986), pages 173–195, by J. Hasker, J. van Esdonk and J. E. Crombeen. In the cathodes described in this article scandium oxide ($Sc_2O_3$) grains of several microns or tungsten (W) grains which are partially coated with either scandium (Sc) or scandium hydride ($ScH_2$) are present at least in the top layer of the cathode body. The cathode body is manufactured by pressing and sintering tungsten grains, whereafter the pores between the grains are impregnated with barium-calcium-aluminate. The barium-calcium-aluminate supplies barium to the emissive surface by a chemical reaction with the tungsten of the matrix in order to maintain electron emission during operation of the cathode. During impregnation, in the cathodes manufactured with W which is partly coated with Sc of $ScH_2$ the Sc is oxidized to $Sc_2O_3$. In a very high load application in, for example, a cathode ray tube for television, it is important that a scandium-containing layer having a thickness of one monolayer be formed on the cathode surface during impregnation by means of a reaction with the impregnant. However, as has been proved in experiments described in the above-mentioned article, the scandium-containing layer may be partly or completely removed by ion bombardment which may occur during the manufacture of such television tubes, which detrimentally affects electron emission during later tube operation. Since $Sc_2O_3$ is not very mobile, said scandium-containing layer cannot be fully regenerated by reactivation of the cathode. As compared with an impregnated tungsten cathode or an impregnated tungsten cathode coated with osmium-rhutenium or irridium, and this may be considered as a drawback.

OBJECTS AND SUMMARY OF THE INVENTION

One of the objects of the invention is to provide scandate cathodes which are considerably improved in comparison with the above-mentioned drawback.

To this end a scandate cathode according to the invention is characterized in that at least the top layer of the cathode body comprises at least one oxidic phase which comprises at least barium and scandium as composite elements. The oxidic phase is preferably non-stoichiometric, with an oxygen deficiency. The phrase "oxidic phase" as used herein refers to a composite oxide. The term "oxygen deficiency" as used herein means that there is an insufficient amount of oxygen present in the composite oxide to balance the positive valences of the metals present in the composite oxide as occurs in the case of stoichiometric oxides. Such an oxygen deficient oxide will therefore be referred to as a non-stoichiometric oxide.

When raising the temperature in vacuo, a monolayer comprising scandium is deposited on the surface of the top layer because scandium (or the scandium-containing compound) segregates from the said oxidic phase. The segregation is presumably promoted by the lower stability of such oxidic phases with respect to, for example, scandium oxide. Due to the segregation, the supply of scandium is maintained, even if the scandium of the monolayer is lost by, for example, ion bombardment. Said segregation is enhanced by an oxygen deficiency in the oxidic phase.

In a preferred embodiment of the invention, the oxidic phase comprises 35–70% by weight of barium, while the quantity of scandium in said oxidic phase is preferably between 5 and 40% by weight.

At these percentages a high emission ($>100$ A/cm$^2$) was achieved, notably in a cathode with oxidic barium-calcium-scandium-aluminum phases, while there was also good recovery after ion bombardment.

The scandate cathode may be of the impregnated type in which the barium compound is introduced into the cathode body by impregnation, but alternatively the cathode may be a pressed scandate cathode or an L-cathode.

The oxidic phases may be produced in different ways, dependent on the selected manufacturing method.

A first method of manufacturing an impregnated cathode according to the invention is characterized in that a matrix is pressed from a mixture of scandium powder or scandium hydride powder and a powder of the high-melting point metal (for example, tungsten), whereafter the scandium (hydride) powder is partly oxidised, if necessary, and the assembly is subsequently sintered and impregnated. The scandium may be obtained by dehydration of scandium hydride. The above-mentioned oxidic phases are produced during impregnation because the scandium oxide and scandium which may still be present reacts with the impregnant.

In accordance with a further aspect of the invention, scandium nitride instead of scandium may be chosen as a starting material. Before sintering and impregnation, a matrix is pressed from the high-melting point material and scandium nitride. Because of its greater stability, scandium nitride is better resistant to high sintering temperatures than scandium and scandium hydride. The scandium nitride nevertheless reacts with the impregnant in such a way that oxidic phases (with an oxygen deficiency) can be produced during impregnation.

To avoid as much as possible loss of scandium by evaporation, the sintering operation is preferably performed in hydrogen (approximately 1 atmosphere) at temperatures up to approximately 1500° C.

In so-called mixed-matrix cathodes, in which the scandium is present throughout the matrix, the quantity of absorbed impregnant depends on the quantities of scandium, scandium hydride, scandium nitride and/or oxidic phases.

Another method is characterized in that the cathode is obtained by mixing, pressing and subsequently sintering of: powders of a high-melting point metal and/or alloy; scandium, scandium nitride or scandium hydride, or scandium or scandium hydride coated with an oxide film, or the oxidic phase; together with the impregnant.

A simpler method is characterized in that the cathode is obtained by mixing, pressing and subsequently sintering of powders of a high-melting point metal and/or alloy together with the powder of one or more oxidic phases. In these methods the sintering temperature is the highest temperature ever achieved by the cathode body, which temperature may be substantially lower than the impregnation temperature which is conventionally used in the methods described hereinbefore.

BRIEF DESCRIPTION OF THE DRAWING

The invention will now be described in greater detail with reference to the accompanying drawing in which.

DESCRIPTION OF THE PREFERRED EMBODIMENT

Figure 1:
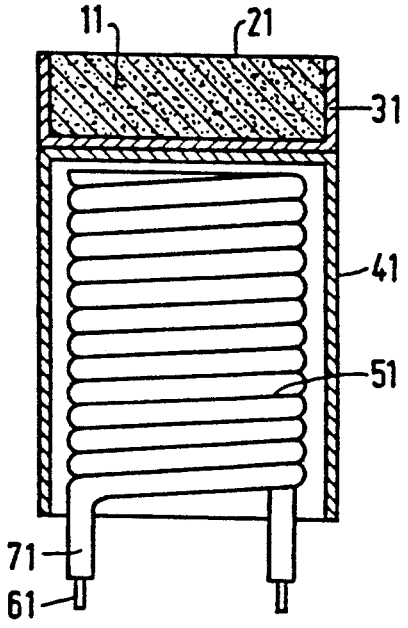
FIG. 1 shows diagrammatically a cathode according to the invention.

FIG. 1 is a longitudinal section view of a scandate cathode according to the invention. The cathode body 11 with an emissive surface 21 and a diameter of, for example 1.8 mm, is obtained by pressing a W powder and a powder of scandium hydride (approximately 0.7% by weight) or scandium, heating to form a matrix the matrix for a number of hours in wet argon at approximately 800° C., and then sintering at 1500° C. in, for example, a hydrogen atmosphere. The thickness of the matrix is then approximately 0.5 mm. The matrix is subsequently impregnated with barium-calcium-aluminate (for example, 4 BaO—1 CaO—1 $Al_2O_3$).

During impregnation, the impregnant reacts with the scandium oxide formed during sintering or with the scandium which is still present to form an oxidic phase (Ba—Ca—AlScO) which can supply scandium during operation of the cathode. EPMA (Electron Probe Micro Analysis) measurements showed the following oxidic phases: $Ba_{20.5}Ca_2Al_{11}Sc_{10}O_{54}$—$Ba_{15}Ca_3Al_3Sc_{21}O_{54}$—$Ba_{11}Ca_4AlSc_{25}O_{54}$ (both with and without an oxygen deficiency).

The cathode body which is thus obtained and which may or may not have an envelope 31 is welded onto the cathode shaft 41. A helical heating filament 51 which may comprise a metal core 61 with an aluminum oxide insulation layer 71, is present in the shaft 41. The emission of such a cathode, after mounting and activation, is measured in a diode arranged at a pulse load and a cathode temperature (brightness temperature) of 950° C. This emission was more than 100 A/cm$^2$.

In another example, the starting material was a tungsten powder and a powder of scandium nitride (approximately 1% by weight) which was pressed and then sintered at approximately 1500° C. in a hydrogen atmosphere. During impregnation with a barium-calcium-aluminate, an oxidic phase was produced from the reaction of the impregnant with the nitride. Dependent on the manufacturing method and the starting materials, the composition of such an oxidic phase may differ and may comprise, for example, 35–70% by weight of barium and 5–40% by weight of scandium. In the relevant example, the oxidic phases had compositions similar to those in the previous example.

Measured in a diode arrangement at a pulse load and a cathode temperature (brightness temperature) of 950° C., the emission of such cathodes was more than 100 A/cm$^2$.

In yet another cathode according to the invention, a cathode body 11 having a diameter of 1.8 mm and a thickness of approximately 0.5 mm is obtained by pressing a mixture of tungsten powder comprising approximately 5% by weight of an oxidic phase, and subsequently sintering the pressed mixture at 1500° C. in a hydrogen atmosphere for 1 hour.

The oxidic phases were $Ba_{20.5}Ca_2Al_{11}Sc_{10}O_{54}$—$Ba_{15}Ca_3Al_3Sc_{21}O_{54}$—$Ba_{11}Ca_4AlSc_{25}O_{54}$, while at least one of the oxidic phases in the mixture had an oxygen deficiency.

The cathode bodies were mounted and tested in the same way as described hereinbefore (after impregnation). The emission was again more than 100 A/cm$^2$.

Moreover, to obtain a comparable emission, subsequent impregnation turned out to be unnecessary if approximately 10% by weight of oxidic phases were used.

A pressed cathode having similar emission properties may alternatively be obtained mixing, pressing and subsequently sintering powders of a high-melting point metal and/or alloy and scandium, scandium hydride or scandium nitride or a powder of the oxidic phase, together with the impregnant powder.

We claim:

1. A dispenser cathode comprising a cathode body which comprises a matrix of a refractory metal or alloy thereof containing a compound for dispensing barium to an emissive surface of the cathode characterized in that the cathode body comprises a composite oxide exhibiting scandium segregation and dispensing scandium to the emissive surface during operation of the cathode, said composite oxide comprising, as composite elements, barium, scandium, calcium, aluminum and oxygen.

2. A scandate cathode as claimed in claim 1, characterized in that the composite oxide is non-stoichiometric with an oxygen deficiency.

3. A scandate cathode as claimed in claim 2, characterized in that the composite oxide comprises 35–75% by weight of barium.

4. A scandate cathode as claimed in claim 2, characterized in that the composite oxide comprises 5–40% by weight of scandium.

5. A scandate cathode as claimed in claim 1, characterized in that the composite oxide comprises 35–75% by weight of barium.

6. A scandate cathode as claimed in claim 5, characterized in that the composite oxide comprises 5–40% by weight of scandium.

7. A scandate cathode as claimed in claim 1, characterized in that the composite oxide comprises 5–40% by weight of scandium.

8. A scandate cathode as claimed in claim 1, characterized in that the composite oxide comprises 35–75% by weight of barium.

9. A scandate cathode as claimed in claim 1, characterized in that the composite oxide comprises 5–40% by weight of scandium.

10. A scandate cathode as claimed in claim 1 wherein said composite oxide comprises a compound selected from the group of stoichiometric and non-stoichiometric, oxygen deficient $Ba_{20.5}Ca_2Al_{11}Sc_{10}O_{54}$, $Ba_{15}Ca_3Al_3Sc_{21}O_{54}$, $Ba_{11}Ca_4AlSc_{25}O_{54}$ and mixtures thereof.

* * * * *